US008099959B2

(12) United States Patent
Takeuchi et al.

(10) Patent No.: US 8,099,959 B2
(45) Date of Patent: Jan. 24, 2012

(54) HEAT RECOVERY EQUIPMENT

(75) Inventors: Yasuhiro Takeuchi, Mihara (JP); Yoshio Nakayama, Mihara (JP); Tsuyoshi Oishi, Mihara (JP); Satoshi Nakamura, Mihara (JP); Shinji Nakamura, Minato-ku (JP); Tsuyoshi Dohi, Minato-ku (JP); Chikayuki Nagata, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 151 days.

(21) Appl. No.: 12/507,186

(22) Filed: Jul. 22, 2009

(65) Prior Publication Data

US 2009/0272114 A1 Nov. 5, 2009

Related U.S. Application Data

(62) Division of application No. 11/288,278, filed on Nov. 29, 2005.

(30) Foreign Application Priority Data

Nov. 29, 2004 (JP) ..... 2004-344219
Mar. 30, 2005 (JP) ..... 2005-099816
Jul. 14, 2005 (JP) ..... 2005-206077

(51) Int. Cl.
*F01K 7/34* (2006.01)
*F01B 31/16* (2006.01)

(52) U.S. Cl. ..... 60/653; 60/670; 60/685

(58) Field of Classification Search ..... 60/653, 60/670, 685

See application file for complete search history.

(56) References Cited

U.S. PATENT DOCUMENTS 3,285,711 A * 11/1966 Stanford ..... 422/168
7,581,395 B2 * 9/2009 Takeuchi et al. ..... 60/653

FOREIGN PATENT DOCUMENTS

| | | |
|---|---|---|
| JP | 55-86882 | 7/1980 |
| JP | 57-35202 | 2/1982 |
| JP | 57-150307 | 9/1982 |
| JP | 58-58294 | 4/1983 |
| JP | 62-049118 | 3/1987 |
| JP | 63-217103 | 9/1988 |
| JP | 5-240764 | 9/1993 |
| JP | 7-56377 | 3/1995 |
| JP | 7-213867 | 8/1995 |

(Continued)

OTHER PUBLICATIONS

Notice of Allowance dated May 15, 2009 in U.S. Appl. No. 11/288,278, filed Nov. 29, 2005 (Takeuchi et al.).

(Continued)

*Primary Examiner* — Hoang Nguyen
(74) *Attorney, Agent, or Firm* — Wenderoth, Lind & Ponack, L.L.P.

(57) ABSTRACT

Heat recovery equipment recovers heat from flue gas. The heat recovery equipment includes a power generation plant that drives a steam turbine by superheated steam produced in a boiler, and an exhaust-gas treatment line that treats flue gas output from the boiler. The exhaust-gas treatment line includes a first air preheater, a heat extractor unit, and a dry electrostatic precipitator. The power generation plant includes a condensed water line. The condensed water line includes a condenser, a condensed water heater, and a low-pressure feedwater heater. The condensed water heater heats water condensed by the condenser with the heat recovered by the heat extractor unit.

9 Claims, 15 Drawing Sheets

FOREIGN PATENT DOCUMENTS

| | | |
|---|---|---|
| JP | 9-170405 | 6/1997 |
| JP | 9-318005 | 12/1997 |
| JP | 11-179147 | 7/1999 |
| JP | 2001-108205 | 4/2001 |
| JP | 2001-239129 | 9/2001 |
| JP | 2002-022140 | 1/2002 |
| JP | 2002-349840 | 12/2002 |
| JP | 2002-370012 | 12/2002 |
| JP | 2003-148805 | 5/2003 |
| JP | 2003-240345 | 8/2003 |

OTHER PUBLICATIONS

Japanese Office Action issued Jun. 15, 2010 in corresponding Japanese Application No. 2005-206077.
Japanese Patent Office Interrogation issued May 17, 2011 in corresponding Japanese Application No. 2005-206077.
Japanese Office Action issued Oct. 25, 2011 in corresponding Japanese Application No. 2005-206077.

* cited by examiner

HEAT RECOVERY EQUIPMENT

This is a divisional application of U.S. patent application Ser. No. 11/288,278, filed Nov. 29, 2005, the entire contents of which are hereby incorporated by reference.

BACKGROUND OF THE INVENTION

1. Field of the Invention

The present invention relates to a technology for recovering heat of flue gas from a boiler.

2. Description of the Related Art

It is known to recover heat of flue gas from a coal burning boiler. Specifically, the heat of the flue gas is recovered before discharging the flue gas.

FIG. 19 is a schematic of a conventional heat recovery equipment disclosed in Japanese Patent Application Laid-open No. H11-179147. In the conventional heat recovery equipment, untreated flue gas A1 discharged from a coal burning boiler 1 is introduced first into heat recovery equipment of an air heater (AH) 2, where heat is recovered from the flue gas A1, and air B to be supplied to the boiler 1 is heated with the recovered heat. As a result of recovery of the heat from the flue gas A1, the temperature of the flue gas A1 drops down to 120° C. to 160° C.

The flue gas A1 is then introduced into a heat extractor unit 3*a* of a non-leakage gas-gas heater (GGH). The non-leakage gas-gas heater recovers heat from the flue gas A1, as a result of which the temperature of the flue gas A1 drops down to about 80° C. to 110° C. The flue gas A1 is then introduced into a dry electrostatic precipitator (ESP) 4. The dry ESP 4 removes a substantial amount of particulate matter from the flue gas A1 and outputs the flue gas A1 as flue gas A2.

The flue gas A2 is then introduced into a soot mixture desulfurization unit 5. The soot mixture desulfurization unit 5 absorbs sulfur dioxide and collects particulate matter from the flue gas A2 thereby removing the sulfur dioxide and the particulate matter to output the flue gas A2 as flue gas A3.

The flue gas A3 output from the desulfurization unit 5 is at a temperature of about 50° C. The flue gas A3 is heated by a heat medium 6, which is heated with the heat recovered from the flue gas A1, in a reheating unit 3*b* of the GGH to a temperature (about 90° C. to 100° C.) desirable for emitting into the air, and discharged from a stack 7 into the air.

However, the conventional equipment does not make fully effective use of heat. It is, therefore, desired to further improve heat efficiency of the equipment and also to improve, for example, power generation efficiency of power generation equipment.

Furthermore, to use the waste heat in the power generation equipment, a heat extractor unit is required to have high reliability. However, a heat extractor unit capable of stably recovering heat at low cost has not been developed. The reheating unit 3*b* provided in a rear side of the desulfurization unit 5 as shown in FIG. 19 is, in particular, in a severe corrosion environment caused by an $SO_3$ fume remaining in the flue gas. It is, therefore, necessary to take measures for preventing corrosion.

Furthermore, in the conventional technology, steel balls (of about 8 millimeters to 10 millimeters in diameter) are constantly dropped to remove soot adhering to a surface of a tube of the heat extractor unit. The tube is, therefore, disadvantageously low in durability.

SUMMARY OF THE INVENTION

It is an object of the present invention to at least solve the problems in the conventional technology.

According to an aspect of the present invention, heat recovery equipment for recovering heat from flue gas includes a power generation plant that drives a steam turbine by superheated steam produced in a boiler, the power generation plant including a condensed water line, the condensed water line including a condenser, a condensed water heater, and a low-pressure feedwater heater in order, and an exhaust-gas treatment line that treats flue gas output from the boiler, the exhaust-gas treatment line including a first air preheater, a heat extractor unit, and a dry electrostatic precipitator in order, wherein the heat extractor unit recovers heat from the flue gas, and the condensed water heater heats water condensed by the condenser with the heat recovered by the heat extractor unit.

According to another aspect of the present invention, heat recovery equipment for recovering heat from flue gas includes a power generation plant that drives a steam turbine by superheated steam produced in a boiler, and an exhaust-gas treatment line that treats the flue gas output from the boiler, the exhaust-gas treatment line including a first air preheater, a heat extractor unit, and a dry electrostatic precipitator in order and a supplementary air preheater that is provided on an air introduction side of the first air preheater, wherein the heat extractor unit recovers heat from the flue gas, and the supplementary air preheater heats the air by the heat recovered by the heat extractor unit.

According to still another aspect of the present invention, heat recovery equipment for recovering heat from flue gas includes a power generation plant that drives a steam turbine by superheated steam produced in a boiler, the power generation plant includes a condensed water line, the condensed water line including a condenser, a condensed water heater, and a low-pressure feedwater heater in order and a supplementary air preheater that is provided on an air introduction side of the first air preheater, and an exhaust-gas treatment line that treats flue gas output from the boiler, the exhaust-gas treatment line including a first air preheater, a heat extractor unit, and a dry electrostatic precipitator in order, wherein the heat extractor unit recovers heat from the flue gas, wherein the condensed water heater heats water condensed by the condenser with the heat recovered by the heat extractor unit, and the supplementary air preheater heats the air by the heat recovered by the heat extractor unit.

According to still another aspect of the present invention, heat recovery equipment for recovering heat from flue gas includes a power generation plant that drives a steam turbine by superheated steam produced in a boiler, an exhaust-gas treatment line that treats flue gas output from the boiler, the exhaust-gas treatment line including a first air preheater, a heat extractor unit, and a dry electrostatic precipitator in order, wherein the heat extractor unit recovers heat from the flue gas, and a heat medium supplied to the heat extractor unit uses condensed water from the steam turbine.

According to still another aspect of the present invention, heat recovery equipment for recovering heat from flue gas includes a power generation plant that drives a steam turbine by superheated steam produced in a boiler, an exhaust-gas treatment line that treats flue gas output from the boiler, the exhaust-gas treatment line including a first air preheater, a second air preheater, and a dry electrostatic precipitator in order, wherein the dry electrostatic precipitator removes particulate matter in the flue gas.

According to still another aspect of the present invention, heat recovery equipment for recovering heat from flue gas includes a power generation plant that drives a steam turbine by superheated steam produced in a boiler, an exhaust-gas treatment line that treats flue gas output from the boiler, the exhaust-gas treatment line including a first air preheater, a heat remover, and a dry electrostatic precipitator in order.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
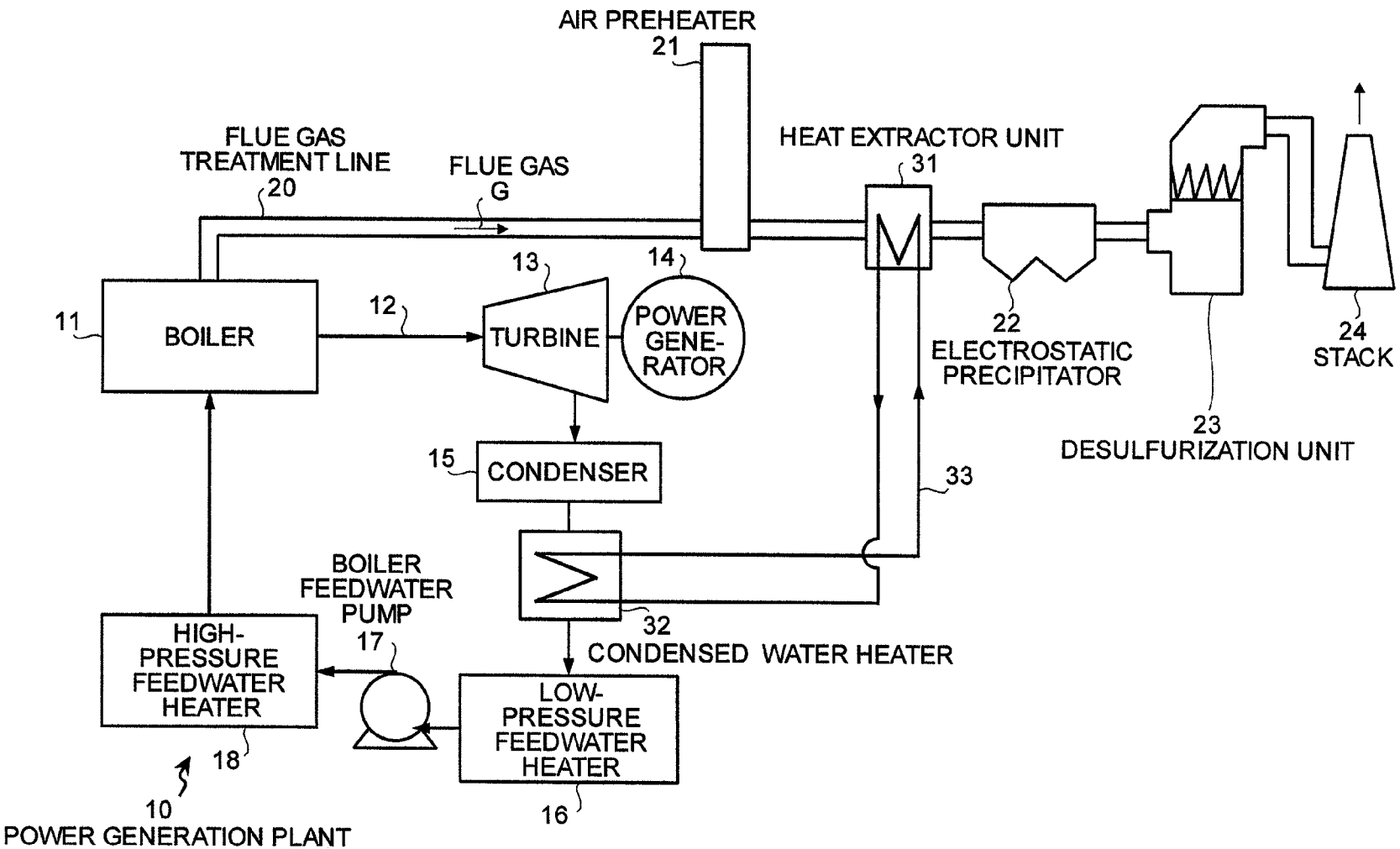
FIG. 1 is a schematic diagram of heat recovery equipment according to a first embodiment of the present invention.

FIG. 1 is a schematic of heat recovery equipment according to a first embodiment of the present invention.

The heat recovery equipment, which recovers heat from flue gas G, includes a power generation plant 10 that drives a steam turbine 13 by superheated steam 12 from a boiler 11, and a flue gas treatment line 20 that treats the flue gas G from the boiler 11. The heat recovery equipment also includes a heat extractor unit 31 and a condensed water heater 32. The heat extractor unit 31 is provided between an air preheater 21 and a dry ESP 22 that are provided on the flue gas treatment line 20. The condensed water heater 32 is interposed between a condenser 15, which is provided on a condensed water line of the power generation plant 10, and a low-pressure feedwater heater 16, and heats condensed water by heat recovered by the heat extractor unit 31. The heat recovery equipment includes a desulfurization unit 23 that removes sulfur oxides in the flue gas, and a stack 24.

An example of a line of the power generation plant 10 will now be explained. The power generation plant 10 includes the condenser 15, the low-pressure feedwater heater 16, and the boiler 11. The condenser 15 cools and condenses flue gas from the turbine 13 that drives a power generator 14. The low-pressure feedwater heater 16 heats the condensed water from the condenser 15 by low-pressure extracted steam from the turbine 13. Dissolved oxygen contained in the condensed water is removed inside the deaerator. The water from the deaerator is pumped by a boiler feedwater pump 17 and passes through a high-pressure feedwater heater 18 which heats the water with high-pressure extracted steam from the turbine 13.

In the first embodiment, the condensed water heater 32 is interposed between the condenser 15 and the low-pressure feedwater heater 16. More preferably, the condensed water heater 32 is provided in a front side of the low-pressure feedwater heater 16 serving as a first feedwater heater. Depending on the equipment, the conventional first feedwater heater can be omitted.

With such a configuring, heat medium recovered by the heat extractor unit 31 in a gas temperature range of from 120° C. to 200° C. is supplied by a heat medium line 33 to the condensed water heater 32, thereby heating the condensed water in a temperature range of 25° C. to 50° C.

As a result, the gas temperature is reduced to an acid-dew point before the gas enters the dry ESP 22, and $SO_3$ in the gas is condensed and adsorbed by particulate matter and removed by the dry ESP 22 together with the particulate matter. In addition, by reducing the gas temperature, a specific resistance of the particulate matter is reduced, a back corona phenomenon that can occur to the dry ESP 22 is avoided, and a particulate matter removal performance of the dry ESP 22 is improved.

The $SO_3$ is collected with high efficiency by setting the flue gas temperature to be equal to or lower than the acid-dew point, thereby realizing an opacity (light shielding degree) reduction effect, an acid corrosion prevention effect in a rear side of the heat extractor unit 31, and a plume reduction effect of reducing plume from the stack 24. As for the opacity reduction effect, after the equipment according to the first embodiment is installed, opacity can be kept unchanged or reduced. If the present equipment is newly installed, the opacity can be reduced to 20% or less.

As for the particulate matter, after the present equipment is installed, the flue gas temperature at an inlet of the dry ESP 22 is reduced, whereby a concentration of the particulate matter in the flue gas at an outlet of the desulfurization unit 23 can be reduced to at least equal to or lower than a present concentration, if the equipment already installed is modified. If the equipment is newly installed, the particulate matter concentration can be reduced to at least 30 $mg/Nm^3$ or less or, depending on the type of the desulfurization unit 23, the particulate matter concentration can be reduced to 10 $mg/Nm^3$ or less.

By reducing the flue gas temperature, the dry ESP 22 can collect not only the particulate matter and the $SO_3$ but also heavy metal such as mercury.

By providing the condensed water heater 32, a part of the extracted steam from the turbine 13 to the low-pressure feedwater heater 16, which has been conventionally used for heating the condensed water, can be reduced. An amount of the steam supplied to the turbine 13 is thereby increased and an output of the turbine 13 is increased accordingly.

Conventionally, the power generation plant 10 heats the condensed water by the extracted steam from a turbine. According to the first embodiment, by contrast, the condensed water heater 32 is provided in the front side of the low-pressure feedwater heater 16 and the condensed water is heated by the recovered heat. Due to this, the extracted steam from the turbine 13 can be partially reduced and the output of the turbine 13 can be increased.

Table 1 represents a result of rough calculation of a heat balance of a plant having a generating-end output of 600 megawatts under rated operation conditions in the equipment shown in FIG. 1. As evident from the Table 1, a condensed water temperature is increased by about 20° C. by providing the condensed water heater 32 on the condensed water line.

TABLE 1

| | | | |
|---|---|---|---|
| Heat extractor side | Treated gas flow rate | 1,632,400 | $Nm^3/h$ |
| | Inlet temperature | 137° | C. |
| | Outlet temperature | 92° | C. |
| | Specific heat | 1.4 | $kJ/(Nm^3 \cdot °C.)$ |
| | Heat amount | 102,841,200 | kJ/h |
| Condensed water heater side | Condensed water flow rate | 1,087 | t/h |
| | | 1,087,000 | kg/h |
| | Inlet temperature | 34° | C. |
| | Outlet temperature | 56.5° | C. |
| | Specific heat | 4.2 | $kJ/(kg \cdot °C.)$ |
| | Heat amount | 102,841,200 | kJ/h |

Specifically, if an inlet temperature of the condensed water introduced into the condensed water heater 32 is 34° C., an outlet temperature thereof passed through the condensed water heater 32 and subjected to heat exchange by the heat medium is 57° C. The power generation equipment having the generating end output of 600 megawatts, has an output increase of about 2,000 kilowatts compared to a conventional output.

Figure 2:
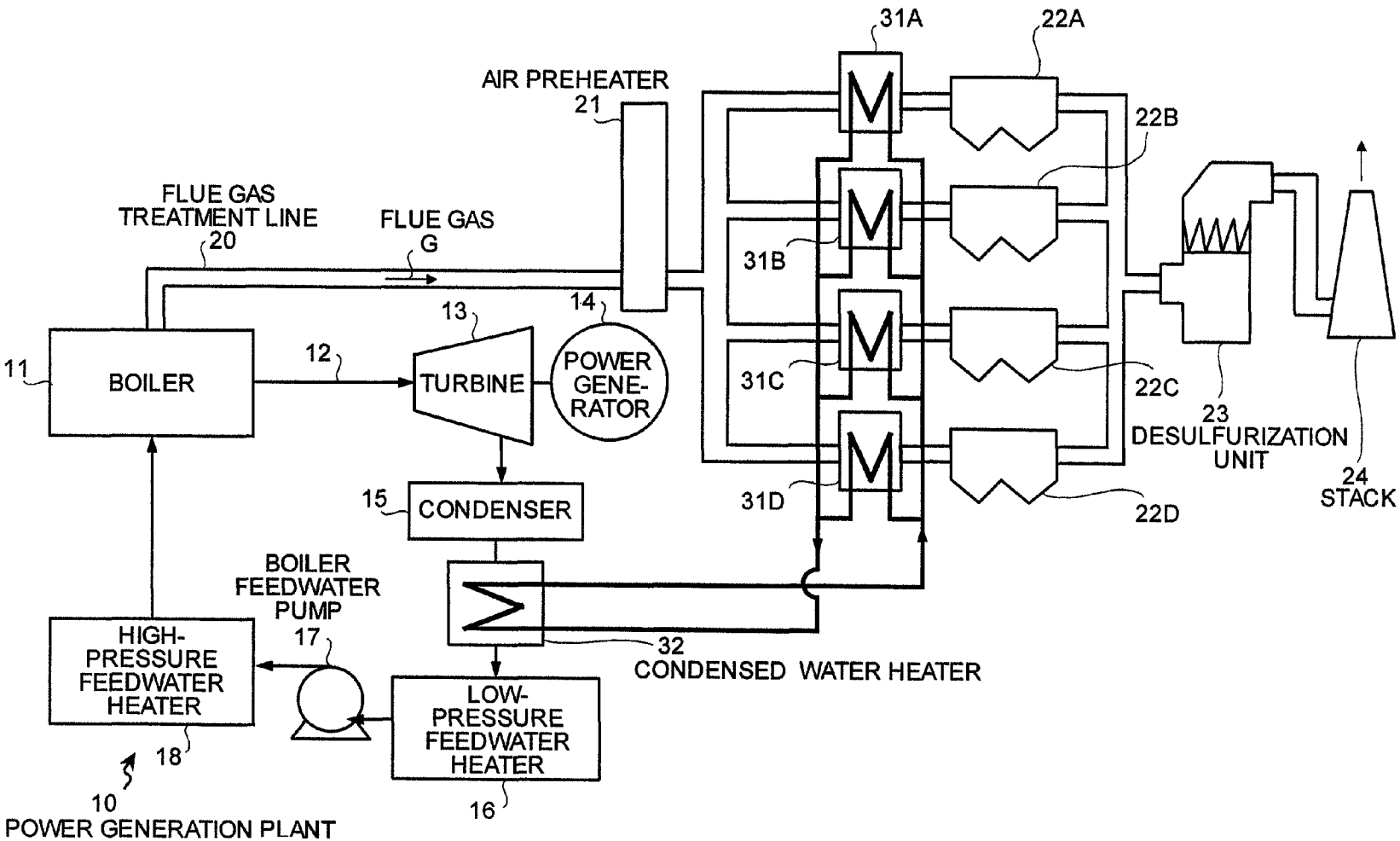
FIG. 2 is a schematic diagram of another heat recovery equipment according to the first embodiment.

Heat recovery equipment in another example according to the first embodiment will next be explained with reference to FIG. 2. This heat recovery equipment includes four heat extractor units 31A to 31D and four dry ESPs 22A to 22D that are provided in a rear side of the respective heat extractor units 31A to 31D.

The flue gas G is branched into four lines and treated by the four lines using the heat extractor units 31A to 31D as well as the corresponding dry ESPs 22A to 22D, respectively. By doing so, even if any line malfunctions, the gas treatment on the failed line can be compensated by the remaining lines. Since a maintenance operation can be performed per line, the operation can be facilitated. In addition, if the gas flow rate is small, the flue gas treatment can be performed by one of the first to the third lines, thereby enabling efficient flue gas treatment.

Figure 3:
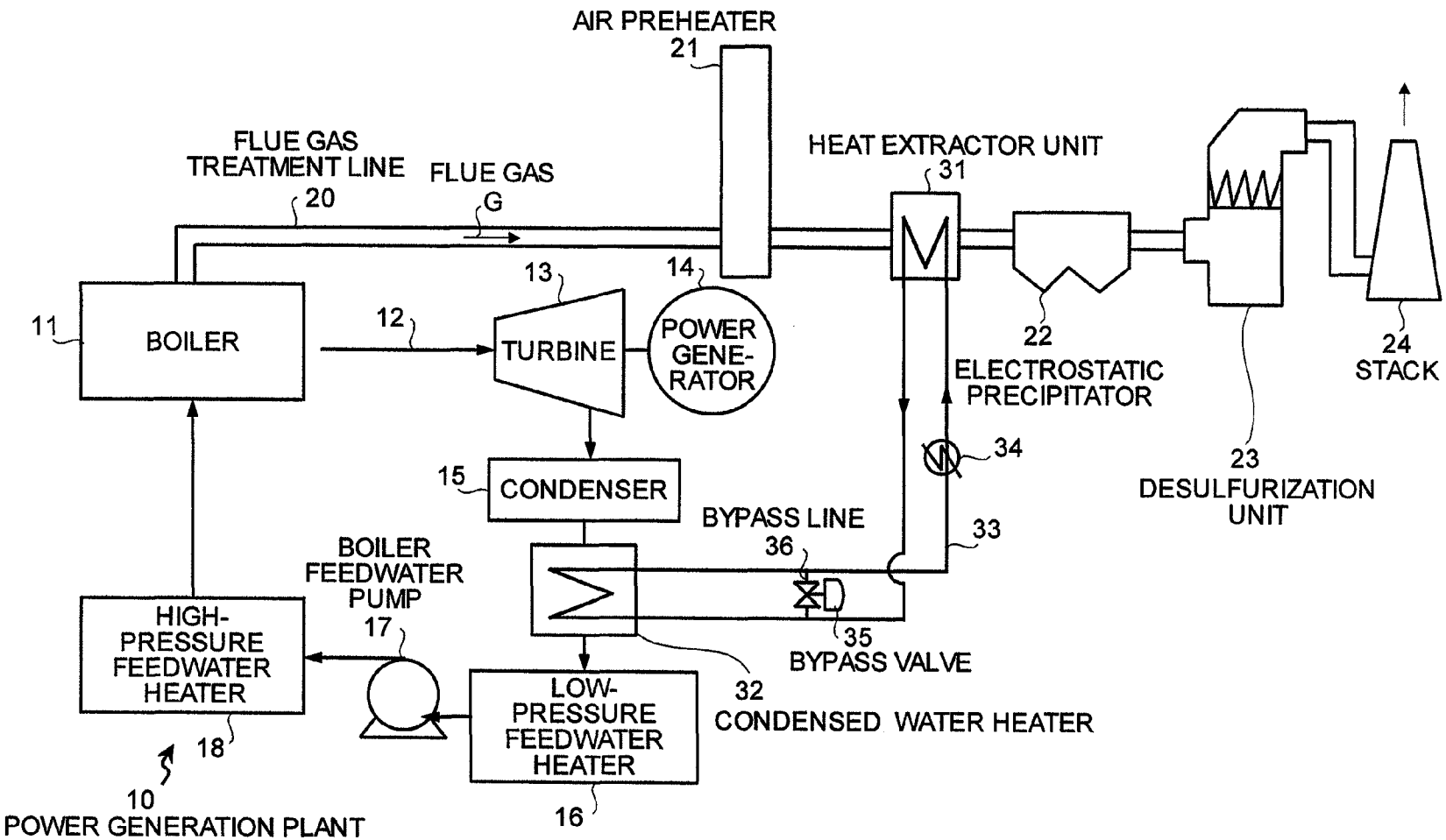
FIG. 3 is a schematic diagram of still another heat recovery equipment according to the first embodiment.

Heat recovery equipment in still another example according to the first embodiment will be explained with reference to FIG. 3. In this example, on the heat medium line 33 from the heat extractor unit 31 to the condensed water heater 32, a heat medium heater 34 that heats the heat medium introduced into the heat extractor unit 31 can be additionally provided.

Because of provision of the heat medium heater 34, the temperature of the heat medium introduced into the heat extractor unit 31 can be controlled. If the particulate matter amount in the flue gas from the boiler 11 is small and the $SO_3$ concentration is high, which are critical conditions of the $SO_3$ corrosion for a heat exchange tube, the temperature of the heat medium is increased by the heat medium heater 34. It is thereby possible to prevent temperature fall in the heat extractor unit 31 and prevent corrosion of the heat exchange tube by the $SO_3$.

As a consequence, the internal corrosion of the heat exchange tube of the heat extractor unit 31 by adhesion of the $SO_3$ to the tube can be prevented.

Furthermore, a bypass line 36 can be provided on the heat medium line 33 and a bypass valve 35 can be provided at the bypass line 36 so as to regulate an amount of the heat medium supplied to the condensed water heater 32.

By providing this bypass line 36, the amount of heat supplied to the condensed water heater 32 can be regulated, and the heat medium can be preferentially returned to the heat extractor unit 31. Accordingly, temperature fall of the heat medium can be suppressed, thereby making it possible to prevent occurrence of the internal corrosion to the tube.

Figure 4:
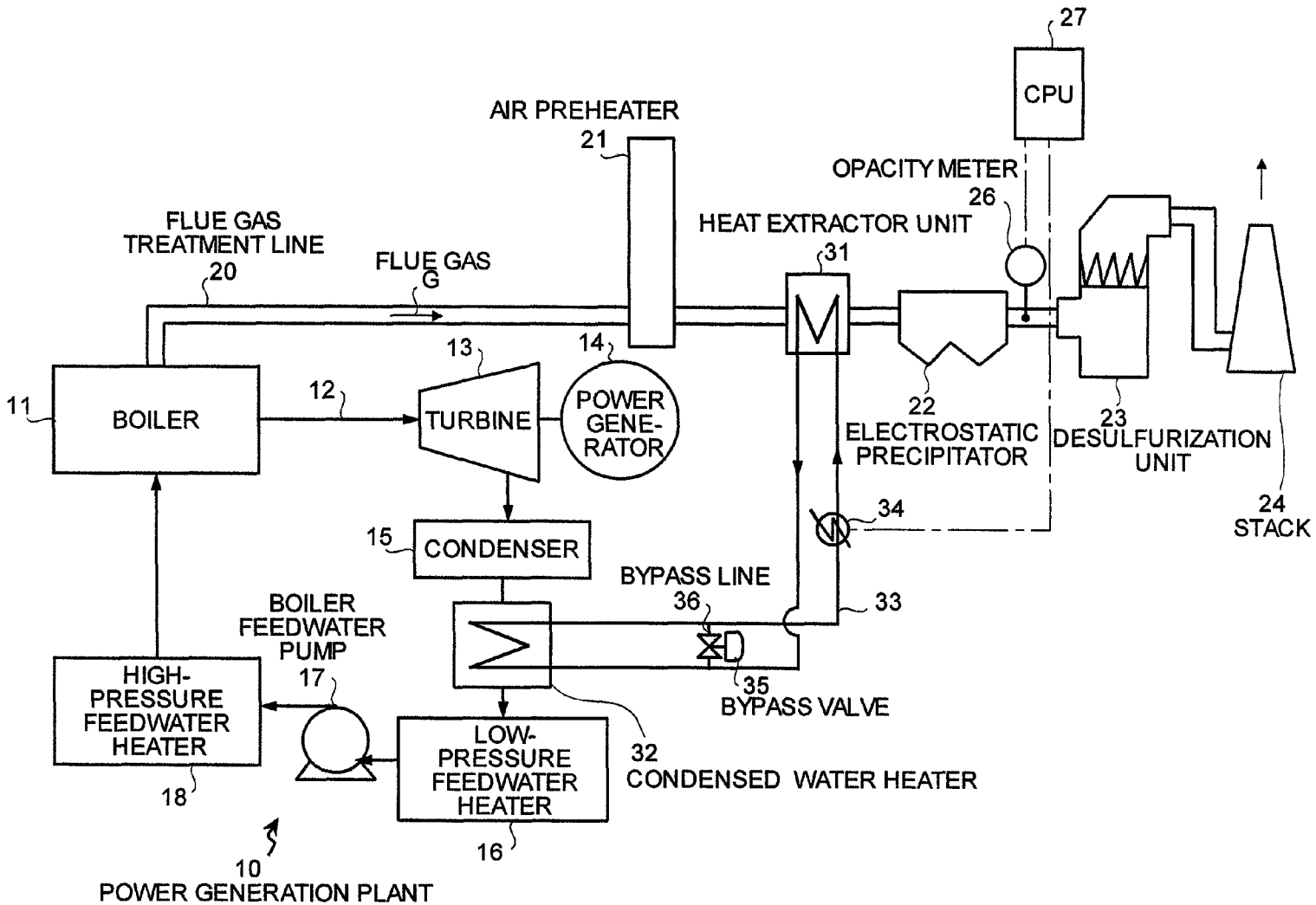
FIG. 4 is a schematic diagram of still another heat recovery equipment according to the first embodiment.

Heat recovery equipment in still another example according to the first embodiment will be explained with reference to FIG. 4. This heat recovery equipment is configured so that an opacity meter 26 that measures the opacity of the flue gas is provided at an outlet side of the dry ESP 22 and so that a controller (CPU) 27 regulates a heating amount of the heat medium heater 34 using a measurement result of the opacity meter 26.

In this example, the opacity meter 26 is provided at the outlet side of the dry ESP 22. However, the present invention is not limited thereto and the opacity meter 26 that measures the opacity of the flue gas can be provided at an outlet side of the desulfurization unit 23.

By configuring so, the temperature of the heat medium is increased, a heat exchange amount of the heat extractor unit 31 per heat extractor unit area is reduced, a gradient of cooling of the flue gas in the heat extractor unit 31 is made gentler, and generation of the $SO_3$ fume can therefore be suppressed. There is known a technique for improving the particulate matter collecting performance of the dry ESP 22 by injecting $SO_3$ in front of the dry ESP 22. According to this example, the concentration of the $SO_3$ fume is regulated to be lower than that of the $SO_3$ fume generated in the conventional technique.

Since the generation of the excessive $SO_3$ fume of a small particle diameter can be suppressed, space charge is not increased and generation of spark discharge in the dry ESP 22 can be suppressed.

Hence, even if an amount of the generated $SO_3$ fume is increased because a type of the coal differs, it is possible to ensure stable flue gas treatment and stable heat recovery.

Figure 5:
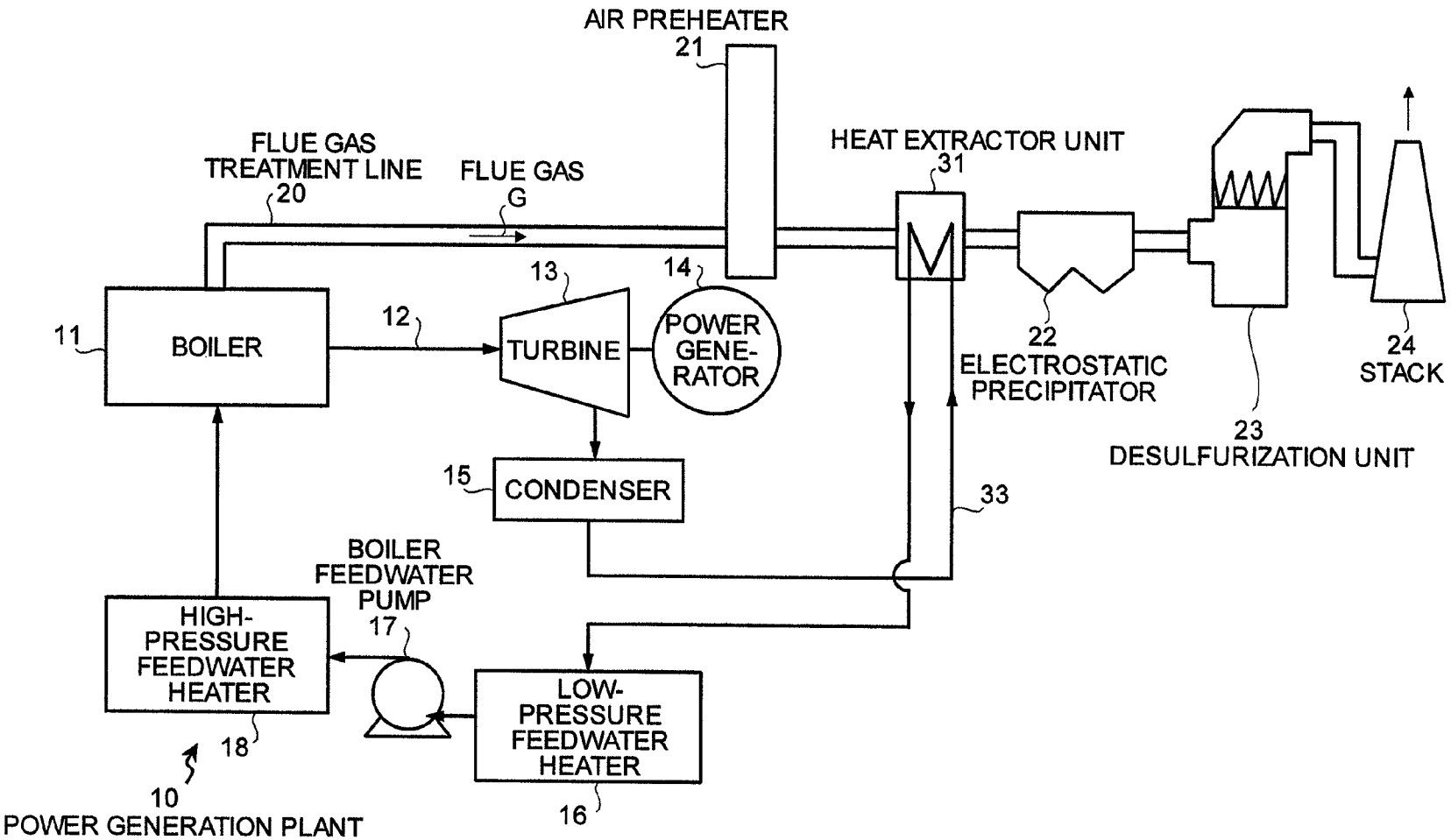
FIG. 5 is a schematic diagram of heat recovery equipment according to a second embodiment.

FIG. 5 is a conceptual view of heat recovery equipment according to a second embodiment. In FIG. 5, like constituent elements of the equipment as those of the heat recovery equipment according to the first embodiment shown in FIG. 1 are denoted by like reference numerals, and redundant explanations thereof are omitted.

According to the first embodiment, the heat recovery equipment includes the condensed water heater 32 to recover the heat. According to the second embodiment, the condensed water is directly used as the heat medium of the heat extractor unit 31 and the equipment does not, therefore, include the condensed water heater 32.

Since it is unnecessary to provide the condensed water heater 32, the heat recovery equipment according to the second embodiment is compact compared to that according to the first embodiment.

Figure 6:
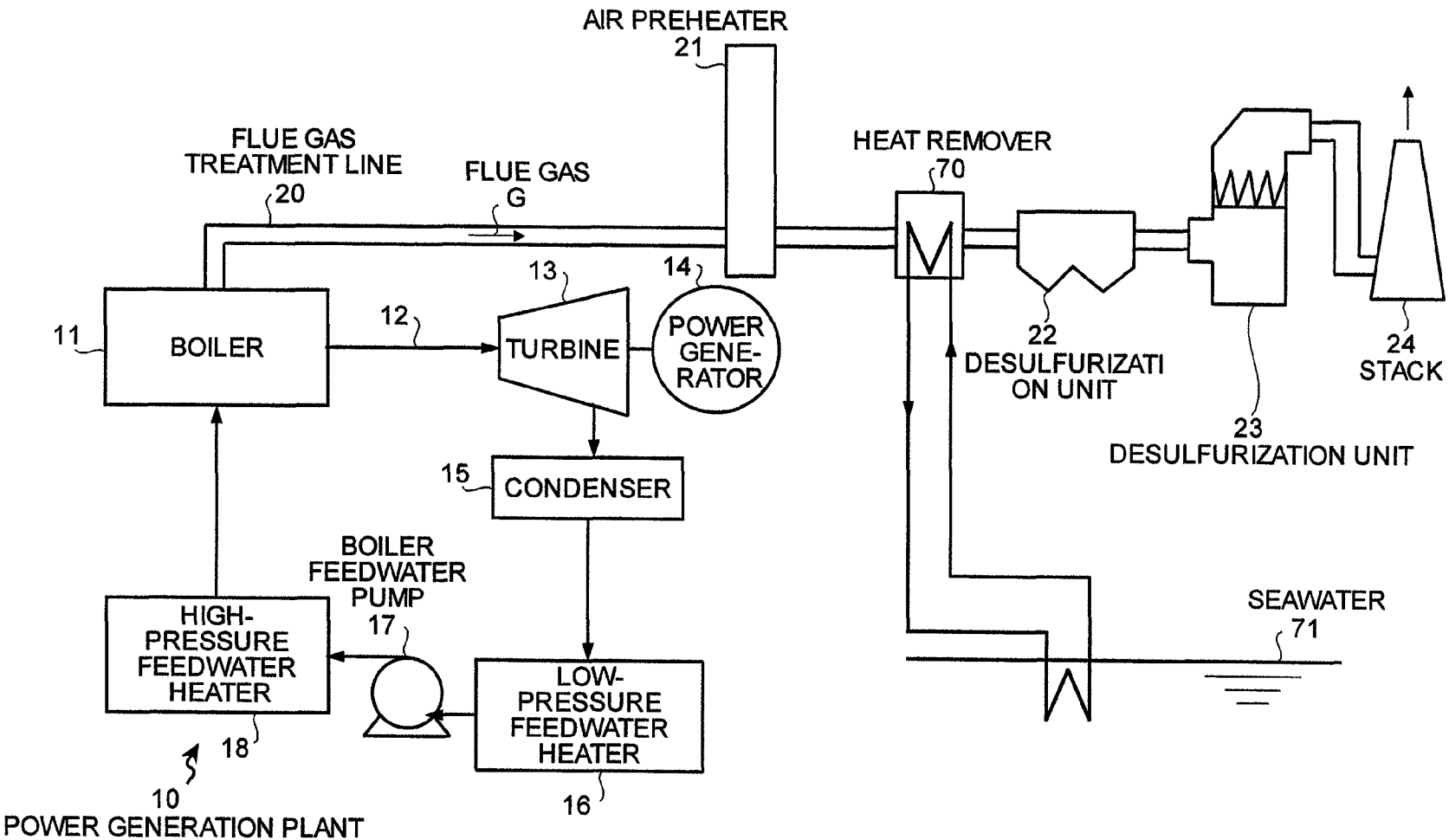
FIG. 6 is a schematic diagram of heat recovery equipment according to a third embodiment.

FIG. 6 is a conceptual diagram of heat recovery equipment according to a third embodiment. In FIG. 6, like constituent elements of the equipment as those of the heat recovery equipment according to the first embodiment shown in FIG. 1 are denoted by like reference numerals, and redundant explanations thereof are omitted.

The heat recovery equipment is configured so that a heat remover 70 is provided between the air preheater 21 and the dry ESP 22 that are provided on the flue gas treatment line 20.

The heat remover 70 uses seawater 71 to which the recovered heat is discharged.

If the heat recovery equipment including the heat remover 70 is compared with the heat recovery equipment that does not include the heat remover 70 under the gas conditions shown in the Table 1, the flue gas temperature that is 137° C. for the equipment that does not include the heat remover 70 can be reduced to 92° C. by providing the heat remover 70. Furthermore, in consideration of a loss of an amount of evaporated water at the high flue gas temperature, water of about 25 ton/h to 30 ton/h can be saved in the desulfurization unit 23.

In the third embodiment, a coolant can be directly pumped up from a sea, a lake, or a river and passed through the heat remover 70 so as to reduce the flue gas temperature.

Moreover, a recovered heat medium can be discharged to the sea, the lake, or the river.

Figure 7:
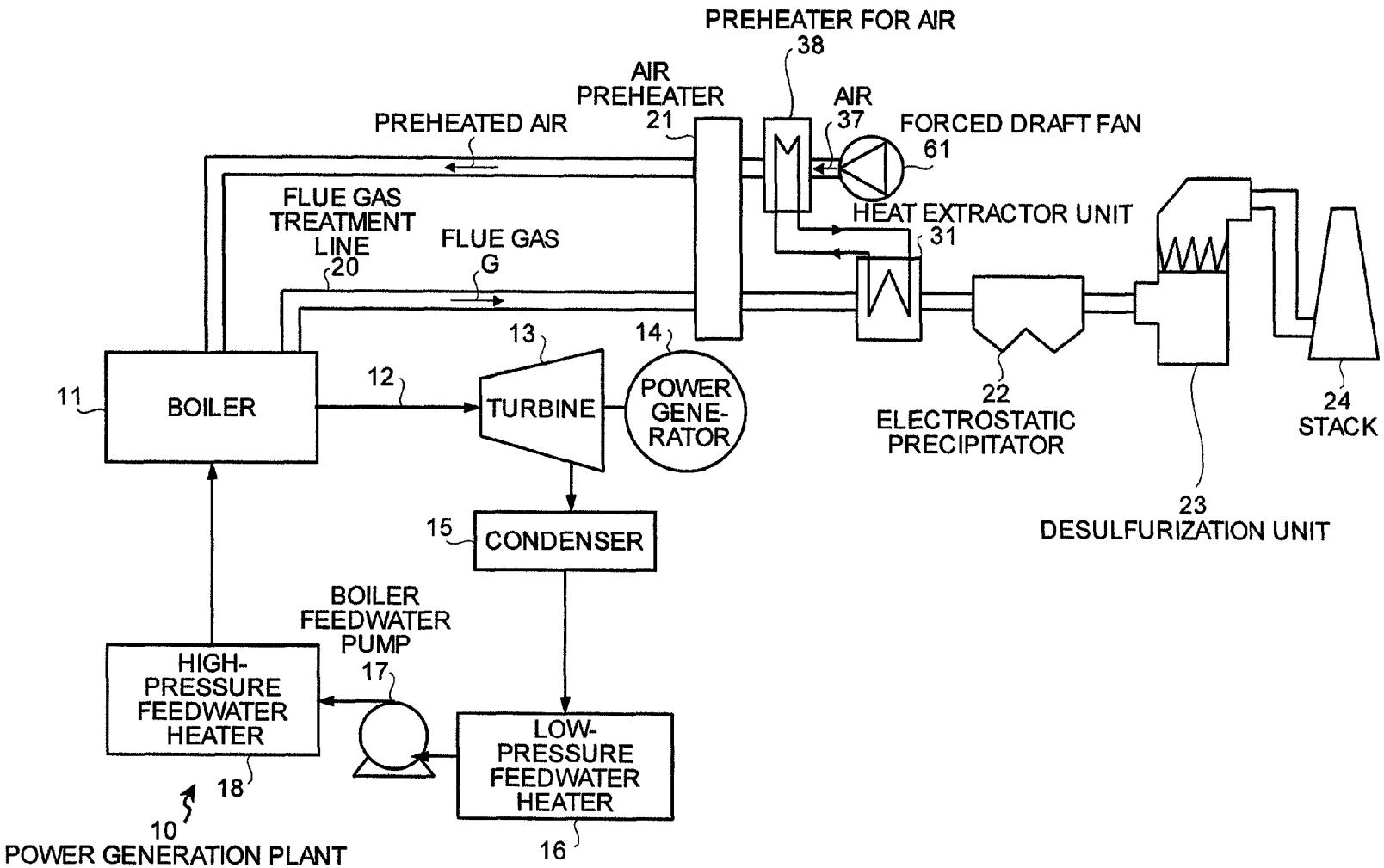
FIG. 7 is a schematic diagram of heat recovery equipment according to a fourth embodiment of the present invention.

FIG. 7 is a conceptual diagram of heat recovery equipment according to a fourth embodiment. In FIG. 7, like constituent elements of the equipment as those of the heat recovery equipment according to the first embodiment shown in FIG. 1 are denoted by like reference numerals, and redundant explanations thereof are omitted.

The equipment according to the first embodiment includes the condensed water heater 32 so as to recover the heat. According to the fourth embodiment, the equipment is configured so that a preheater 38 for the air that heats air 37 introduced through a forced draft fan 61 is provided in a front side of the air preheater 21 that preheats the air to be supplied to the boiler 11.

By providing the preheater 38 for the air, a temperature of the air 37 forced in from the outside by the forced draft fan 61 is increased by the heat medium from the heat extractor unit 31, and the influence of corrosion due to condensation of the $SO_3$ in an element of the air preheater 21 that generates the preheated air can be lessened. Accordingly, the life of the element of the air preheater 21 can be lengthened.

Figure 8:
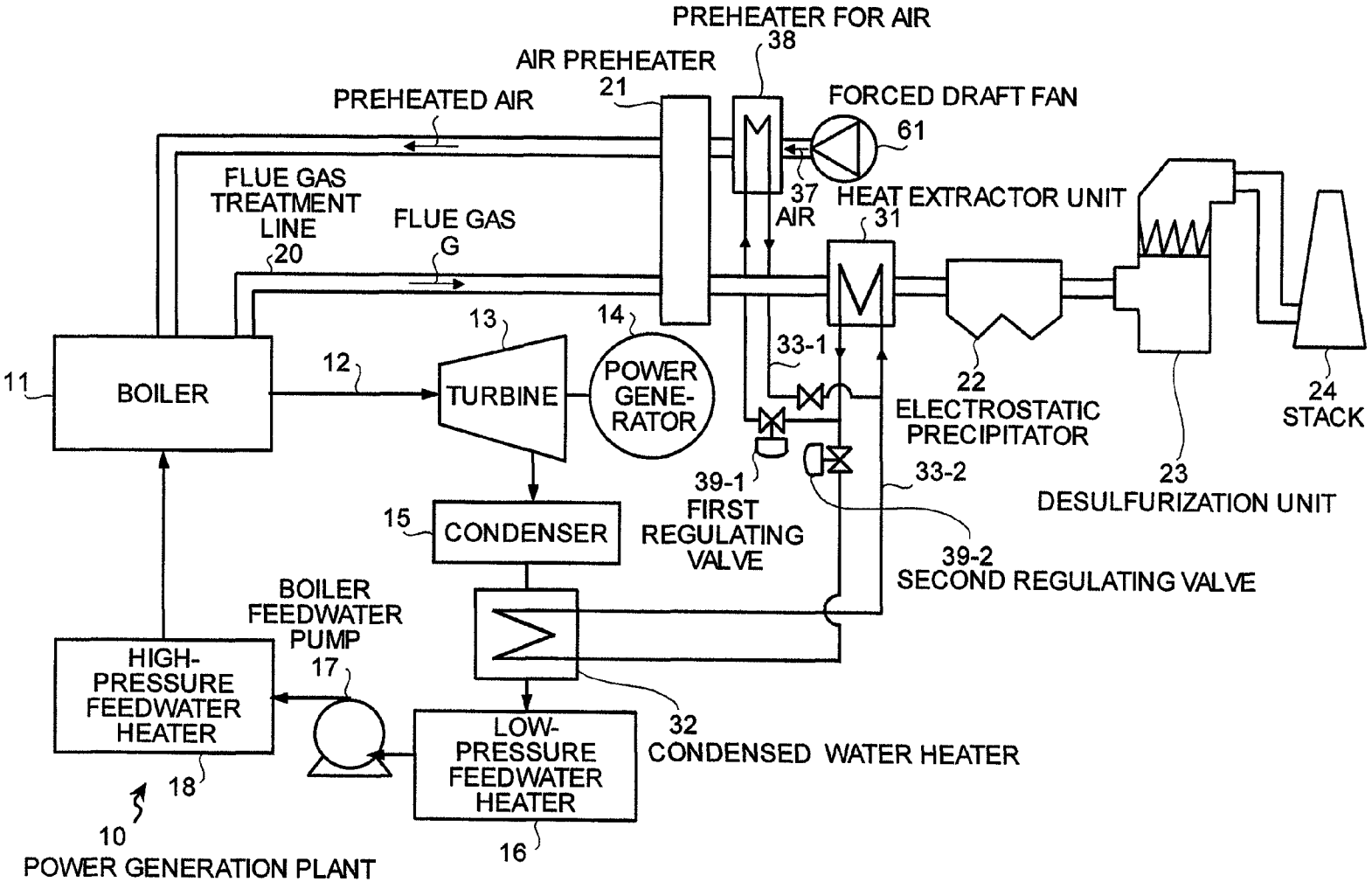
FIG. 8 is a schematic diagram of heat recovery equipment according to a fifth embodiment of the present invention.

FIG. 8 is a conceptual diagram of heat recovery equipment according to a fifth embodiment. In FIG. 8, like constituent elements of the equipment as those of the heat recovery equipment shown in FIGS. 1 to 7 are denoted by like reference numerals, and redundant explanations thereof are omitted.

The heat recovery equipment is a combination of the heat recovery equipment according to the first embodiment shown in FIG. 1 and the heat recovery equipment according to the fourth embodiment shown in FIG. 7. In addition, the heat recovery equipment according to the fifth embodiment is configured so that a first regulating valve 39-1 and a second regulating valve 39-2 that regulate an amount of the heat medium flowing into either the condensed water heater 32 or the preheater 38 for the air are provided on heat medium lines 33-1 and 33-2, respectively.

By providing the first regulating valve 39-1 and the second regulating valve 39-2, excessive heat supply for heating either the condensed water or the forced air 37 can be avoided.

That is, if the boiler 11 operates at low load, the first regulating valve 39-1 and the second regulating valve 39-2 are regulated so as to preheat the air 37. If the boiler 11 operates at high load, the first regulating valve 39-1 and the second regulating valve 39-2 are regulated so as to preheat the condensed water.

Accordingly, the waste heat of the flue gas can be used effectively according to a condition of the equipment, and operation efficiency of the equipment can be optimized.

Figure 9:
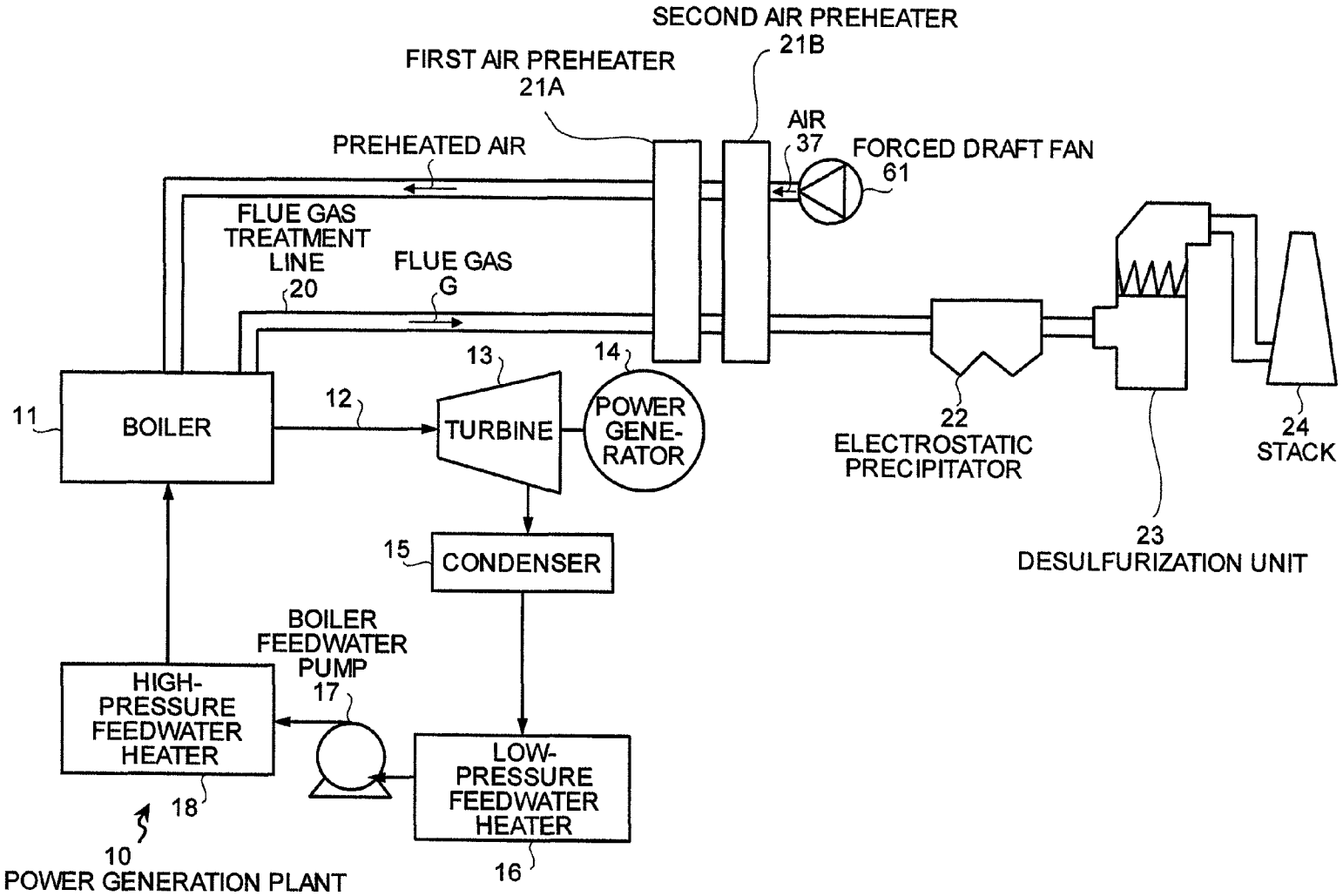
FIG. 9 is a schematic diagram of heat recovery equipment according to a sixth embodiment of the present invention.

FIG. 9 is a conceptual diagram of heat recovery equipment according to a sixth embodiment. In FIG. 9, like constituent elements of the equipment as those of the heat recovery equipment shown in FIGS. 1 to 8 are denoted by like reference numerals, and redundant explanations thereof are omitted.

The heat recovery equipment according to the sixth embodiment is configured so that one more rotary air preheater is provided and two air preheaters 21A and 21B are provided in all, as compared with the heat recovery equipment according to the fourth embodiment shown in FIG. 7, in which heat exchange between the heat extractor unit 31 and the preheater 38 for the air is performed on the heat medium line thereof.

With such a configuring, the temperature of the flue gas G introduced into the dry ESP 22 can be further reduced and the particulate matter removal performance of the dry ESP 22 for removing the particulate matter and the $SO_3$ can be improved, as compared with the equipment including only one air preheater 21.

In addition, a preheating temperature of the external air 37 is increased and plant efficiency is thereby improved.

Furthermore, by providing the two air preheaters 21A and 21B in series, the air supplied from the outside is preheated at two stages, and the heat temperature of the flue gas G discharged to the outside is reduced at two stages. As compared with the equipment including one air preheater 21, a gradient of heat temperature fall of the flue gas is gentle. Accordingly, the generation of the $SO_3$ fume in the flue gas G can be suppressed. It is, therefore, possible to reduce corrosion of the equipment in a rear side of the preheaters 21A and 21B by the $SO_3$, and lengthen the life of the equipment.

In the above embodiments, the heat recovered by the heat recovery equipment is used to heat the condensed water or the air. However, the present invention is not limited thereto and the heat can be used for heat trace, heating, hot-water production, and the like of the equipment.

Figure 10:
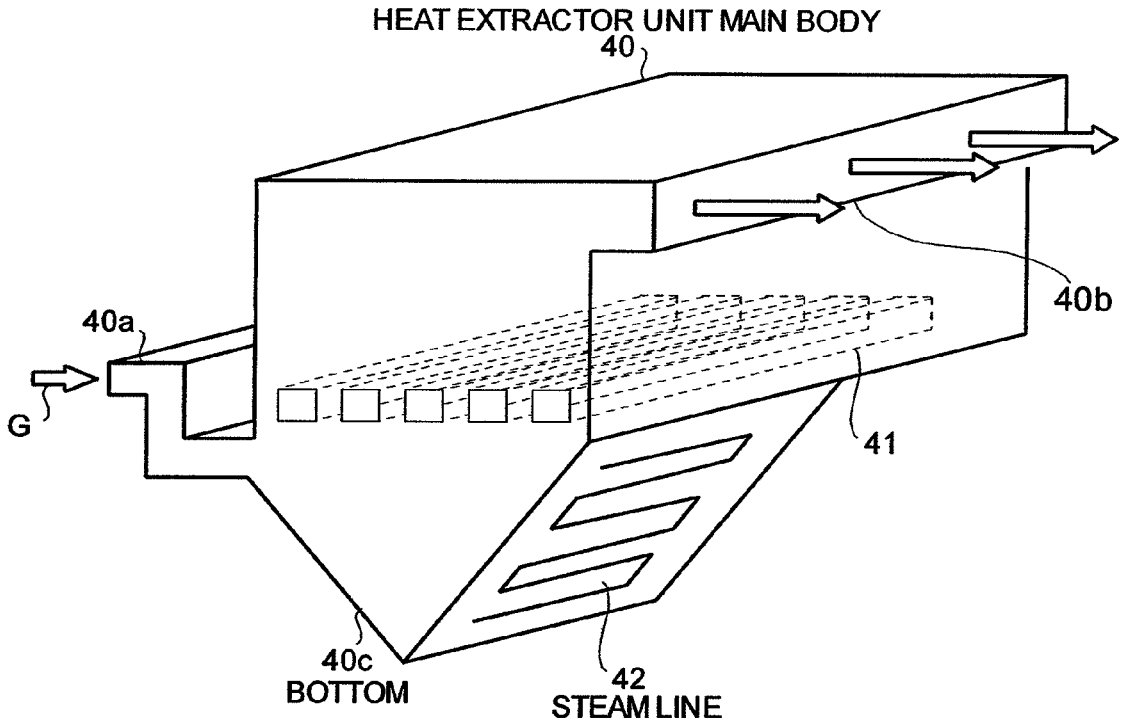
FIG. 10 is a perspective view of a heat extractor unit according to a seventh embodiment of the present invention.
Figure 11:
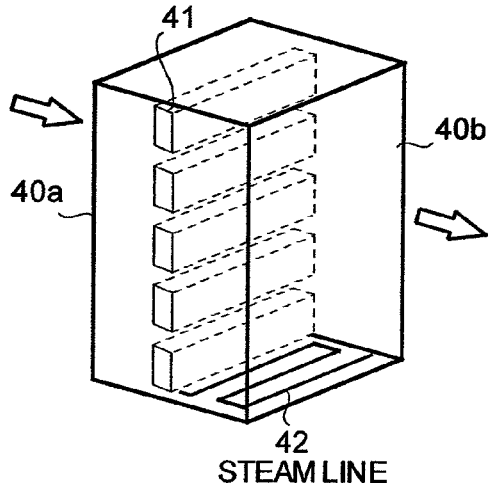
FIG. 11 is another perspective view of the heat extractor unit according to the seventh embodiment.

FIG. 10 is a perspective view of the heat extractor unit 31 according to a seventh embodiment. FIG. 11 is a front view of the heat extractor unit 31 shown in FIG. 10. The heat extractor unit 31 includes a heat extractor unit main body 40, a tube bundle 41, and a steam line 42. The heat extractor unit main body 40 includes an inlet 40*a* for introducing the flue gas from which heat is to be recovered and an outlet 40*b* for emitting the flue gas from which heat is recovered. The tube bundle 41 is a collection of a plurality of heat transfer tubes for recovering the heat of the flue gas G. The steam line 42, which is provided on a bottom 40*c* of the heat extractor unit main body 40, heats the entire bottom 40*c*.

Figure 12:
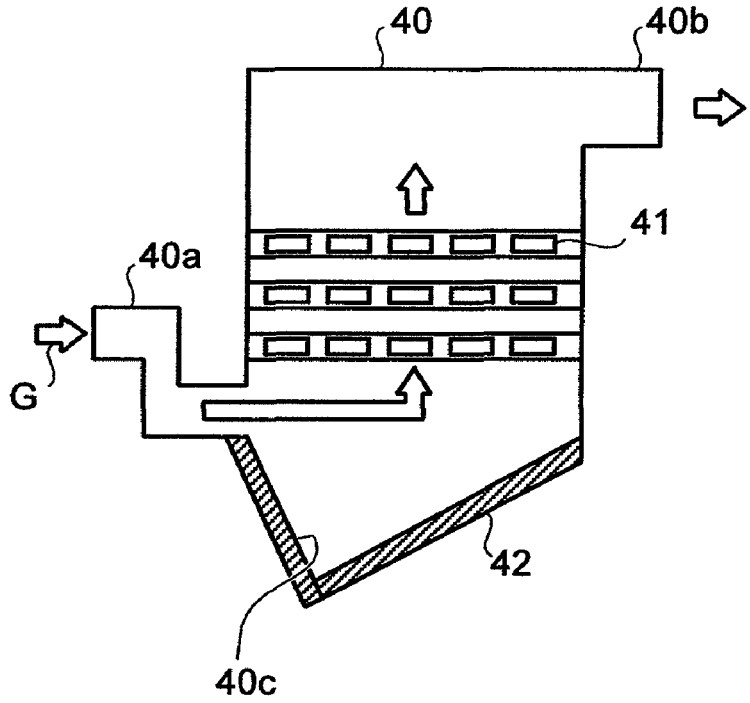
FIG. 12 is a front view of the heat extractor unit according to the seventh embodiment.
Figure 13:
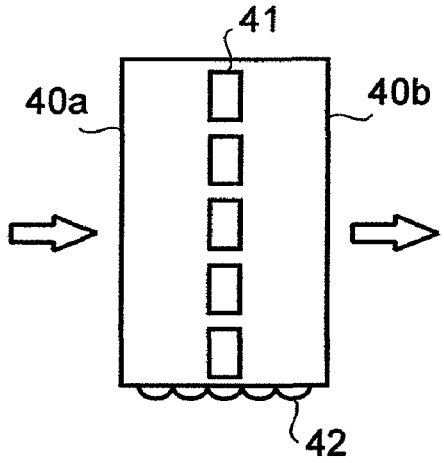
FIG. 13 is another front view of the heat extractor unit according to the seventh embodiment.

A gas flow is not limited to a vertical gas flow as shown in the heat extractor unit 31 shown in FIGS. 10 and 11, and can be a horizontal gas flow. FIGS. 12 and 13 are examples of the heat extractor unit 31 having the horizontal gas flow. FIG. 12 is a perspective view and FIG. 13 is a front view.

The steam supplied to the steam line 42 can be at a temperature of about 70° C. to 180° C.

By providing the steam line 42, the entire bottom 40*c* of the heat extractor unit main body 40 can be heated by the steam, and falling soot accompanying the flue gas G to be supplied to the heat extractor unit main body 40 is heated. When the soot is heated, moisture absorption of the $SO_3$ adhering to the soot is reduced. It is discovered that when a moisture content of the flue gas G is 10% and the temperature is increased by 20° C., the moisture absorption of the $SO_3$ is reduced by about 10%. By reducing the moisture content of the soot, fluidity of the soot is improved, and the soot accompanies again the flue gas G and can be easily introduced into a particulate matter collecting hopper (not shown) provided at the back side.

Accordingly, even if the gas flow to the heat extractor unit 31 is horizontal, the soot does not stay on the bottom 40*c* of the heat extractor unit main body 40. Thus, not only the vertical flow heat extractor unit but also the horizontal flow heat extractor unit can be used in the heat recovery equipment according to the seventh embodiment.

As a material for the heat exchange tube of the heat extractor unit 31 according to the seventh embodiment, inexpensive carbon steel can be used. In addition, the heat exchange tube is preferably a finned tube capable of improving the heat recovery efficiency and increasing a particulate matter adhesion area.

Furthermore, by providing the heat extractor unit 31 according to the seventh embodiment in the heat recovery equipment according to the first to the fifth embodiments shown in FIGS. 1 to 8, the heat recovery efficiency is improved.

Figure 14:
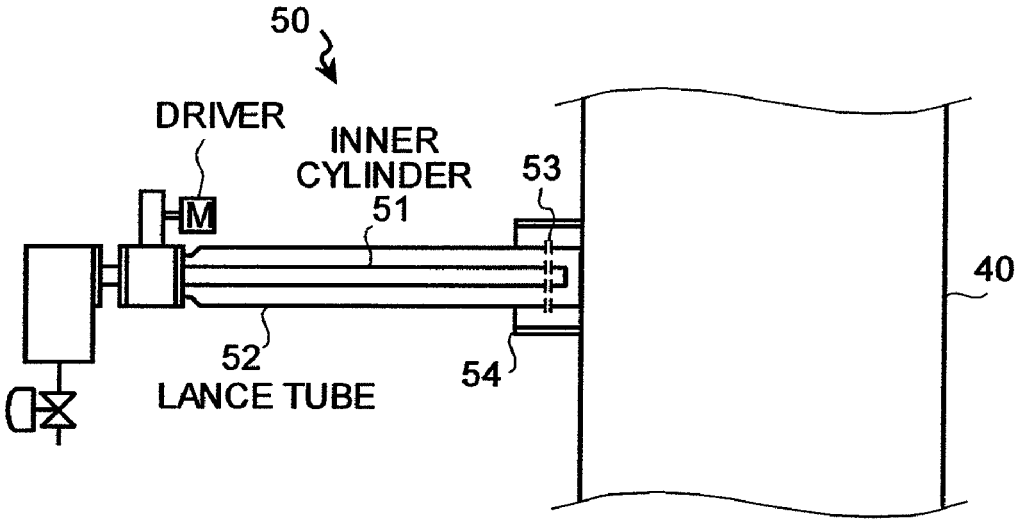
FIG. 14 is a schematic diagram of a soot blower according to an eighth embodiment of the present invention.
Figure 15:
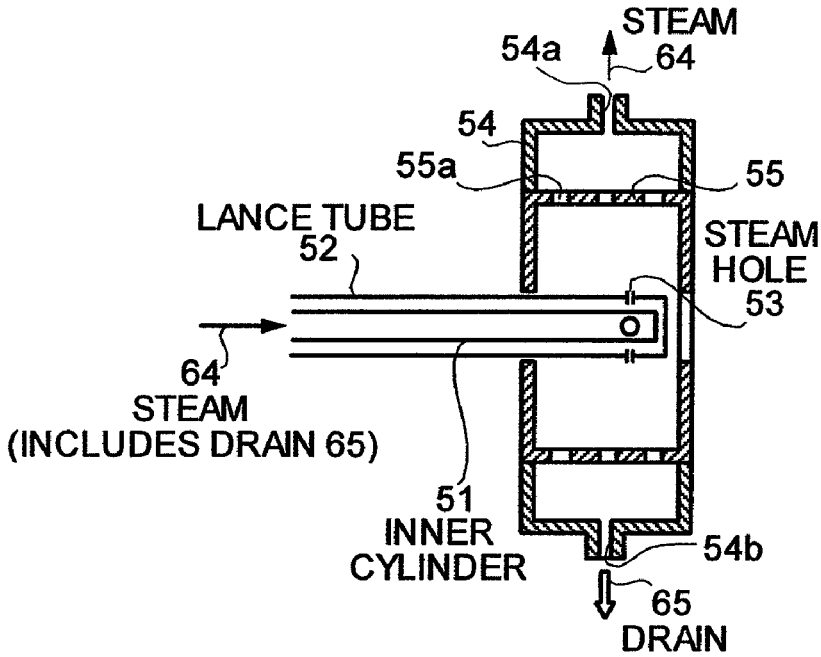
FIG. 15 is a longitudinal sectional view of a drain remover shown in FIG. 14.
Figure 16:
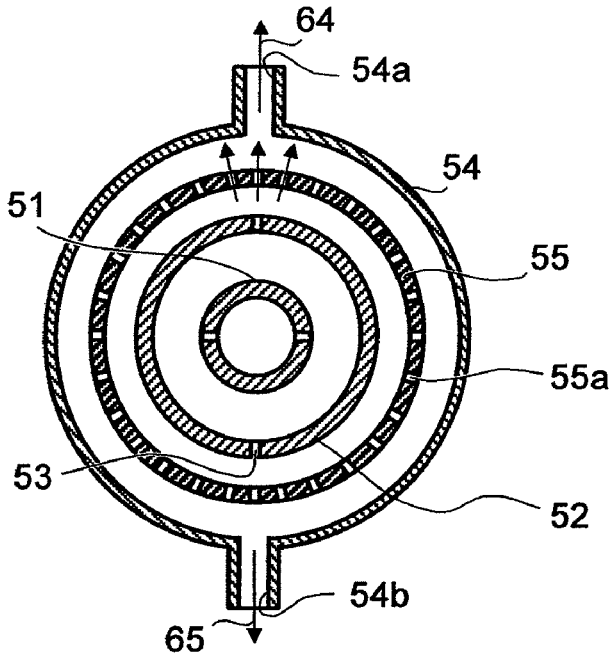
FIG. 16 is a cross section of the drain remover shown in FIG. 15.
Figure 17:
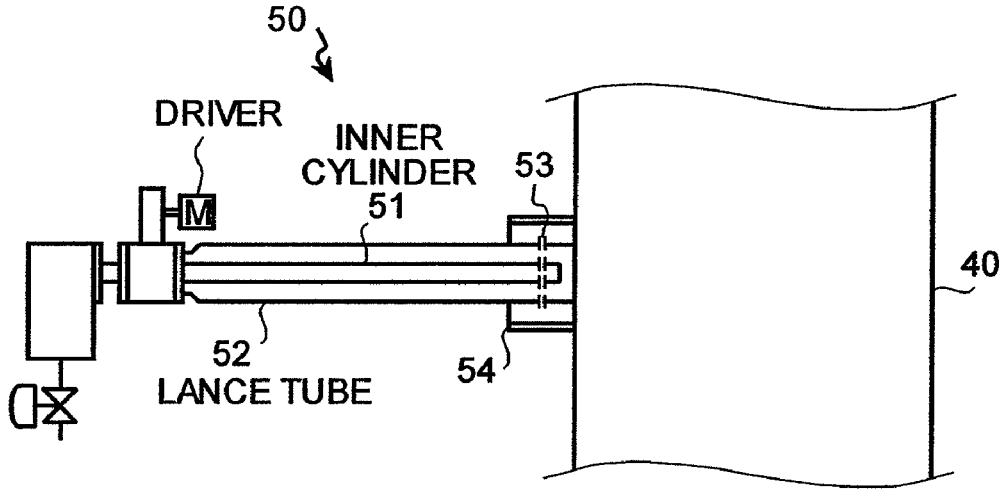
FIG. 17 is a schematic diagram that depicts an initial operation of the soot blower shown in FIG. 14.
Figure 18:
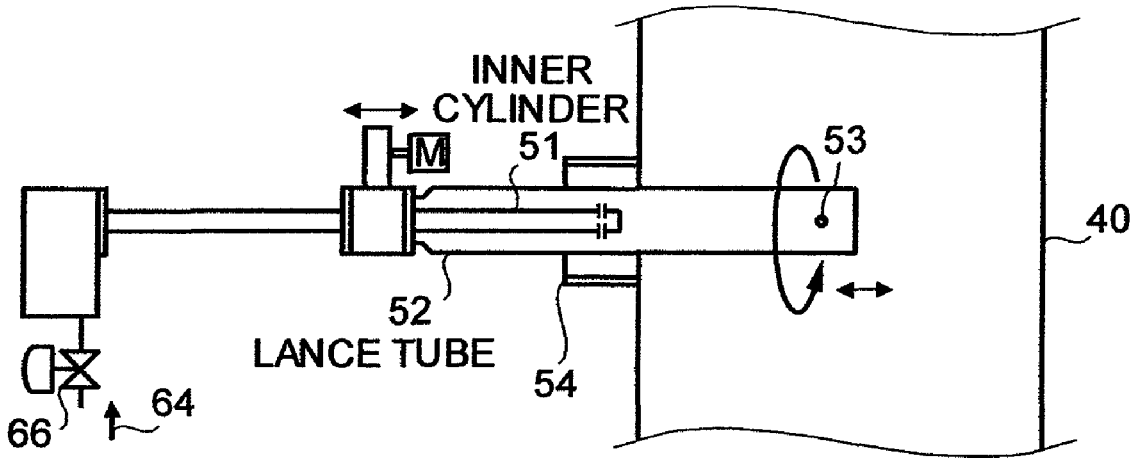
FIG. 18 is a schematic diagram that depicts an operation of the soot blower shown in FIG. 14.
Figure 19:
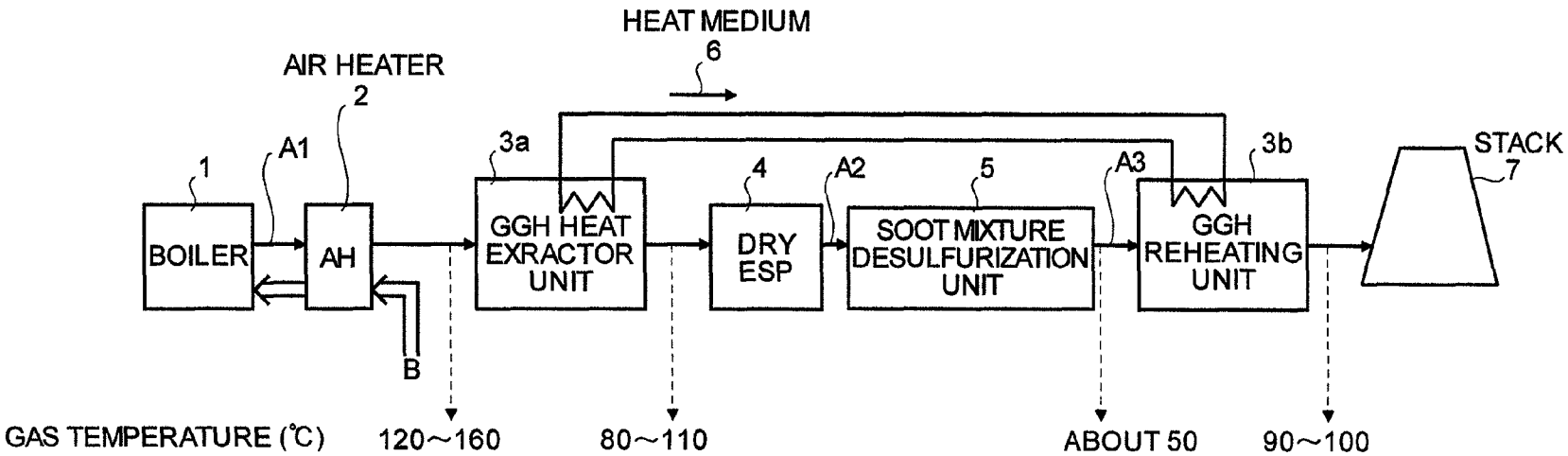
FIG. 19 is a schematic diagram of conventional heat recovery equipment.

FIG. 14 is a conceptual diagram of a soot blower 50 according to an eighth embodiment used for the heat extractor unit 31. FIGS. 15 and 16 are sectional views of a prepurge box, and FIGS. 17 and 18 are schematic diagrams that depict operations of the soot blower 50. The soot blower 50 is inserted into the heat extractor unit main body 40 for brushing off soot of the tube bundle by high-temperature and high-pressure steam. The soot blower 50 includes an inner cylinder 51 serving as a first cylinder that introduces the high-temperature, high-pressure steam from the boiler, a lance tube 52 serving as a second cylinder that can be freely inserted into and pulled out from the inner cylinder 51, and a steam hole 53 provided on a pullout-side tip end of the lance tube 52. The lance tube 52 can be driven by a driver M to be able to perform a feed/return operation and a rotation operation simultaneously.

In the eighth embodiment, the soot blower 50 is configured so that the lance tube 52 is moved on the outside of the inner cylinder 51, however, the invention is not limited thereto. The lance tube 52 can be freely inserted into and pulled out from the first cylinder 51.

It is more preferable that the lance tube 52 is used as the outer cylinder as shown in the eighth embodiment since the driver M for insertion and pullout can be provided.

By providing the driver M, the lance tube 52 is driven to be moved into and out of the heat extractor unit main body 40 and to brush off the soot adhering to the tube bundle 41 by atomized steam.

Furthermore, a drain remover 54 that removes steam drain caused by the soot blower 50 in initial soot blowing is provided on a side surface of the heat extractor unit main body 40. The soot blower 50 operates only several times a day. The drain remover 54, therefore, removes the steam drain in the steam line 42 generated while the steam blower 50 is not operating. At the gas temperature (about 90° C. to 120° C.) of the heat extractor unit 31 that includes the soot blower 50, if the drain is atomized into high-temperature particulate matter, the particulate matter fixedly adheres to the heat extractor unit main body 40 and adversely influences overall operation of the plant. It is essential to remove the drain during the soot blowing.

As shown in FIGS. 15 and 16, the drain remover 54 includes a gas-liquid separation cylinder 55 having a plurality of fine holes 55*a* circumferentially formed. The gas-liquid separation cylinder 55 separates gas and liquid of the steam drain ejected from a steam hole 53. Steam 64 is discharged from a hole 54*a* formed on a top of the drain remover 54 in a vertical axis direction whereas drain 65 is discharged from a hole 54*b* formed on a bottom of the drain remover 54.

By using the drain remover 54, in initial soot blowing, a regulating valve 66 on the steam line 42 is released as shown in FIG. 17, thereby emitting the drain steam 65 from the steam hole 53 on a tip end of the lance tube 52 within the drain remover 54. The steam 65 can be discharged for a substantial time to remove the drain within the lance tube 52. Alternatively, a thermometer can be provided at a position within the drain removing device 54 where the steam is not directly applied to the thermometer, and it can be confirmed that no drain is generated based on a change of the temperature measured by the thermometer.

After no drain is generated from the steam, the lance tube 52 is inserted into the heat extractor unit main body 40 by releasing a shutter (not shown), and the soot adhering to the tube bundle 41 is blown off. The lance tube 52 can be rotated by 360 degrees by a rotation device (not shown) so as to blow off the soot by the steam in all corners of the heat extractor unit main body 40. After the soot is blown off, the lance tube 52 is stored in the drain remover 54 and the shutter is pulled down.

The steam used by the soot blower 50 is designed not to generate the drain even in a pipe upstream of the soot blower 50. A branch of a main steam pipe branched to each soot blower 50 is set as short as possible and the main steam pipe is designed to constantly circulate the steam.

With such a configuring, the steam drain staying on the steam line 42 and within the lance tube 52 can be discharged in the initial soot blowing, and only the high-temperature, high-pressure steam is supplied during the soot blowing. It is, therefore, possible to prevent solidification and adhesion of the soot.

Thus, even if inexpensive carbon steel is used as the material for the heat exchange tube of the heat extractor unit 31, the adhesion of the soot can be reduced by the soot blower 54 and stable heat recovery can be performed for a long time.

Furthermore, it suffices to perform about two to three or four soot blowing operations a day without constantly dropping steel balls as done in the conventional technique. The durability of the heat extractor unit 31 can be improved.

Furthermore, a dummy tube that does not supply the heat medium to the upstream heat recovery tube of the tube bundle 41 which initially contacts with the flue gas G can be provided. By doing so, even if a hole is made by friction of the soot in the tube on the upstream side having a high flow rate, the heat medium is not influenced by the hole and the reliability of the heat extractor unit 31 can be improved.

According to an aspect of the present invention, heat can be recovered effectively from flue gas.

Furthermore, when the soot adhering to the heat extractor unit is removed, soot blowing can be performed while removing the steam drain. Accordingly, the reliability of the heat extractor unit can be improved.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. Heat recovery equipment for recovering heat from flue gas, comprising:

a power generation plant configured to drive a steam turbine by superheated steam produced in a boiler, said power generation plant includes a condensed water line, said condensed water line including a condenser, a condensed water heater, and a low-pressure feedwater heater in order and a supplementary air preheater that is provided on an air introduction side of the first air preheater; and an exhaust-gas treatment line configured to treat flue gas output from said boiler, said exhaust-gas treatment line including a first air preheater, a heat extractor unit, and a dry electrostatic precipitator in order, wherein said heat extractor unit is configured to recover heat from the flue gas, wherein said condensed water heater is configured to heat water condensed by said condenser with the heat recovered by said heat extractor unit, and said supplementary air preheater is configured to heat the air by the heat recovered by said heat extractor unit.

2. The heat recovery equipment according to claim 1, further comprising:

a regulating device configured to regulate a heat supply amount of the heat medium supplied to said condensed water heater and said supplementary air preheater.

3. The heat recovery equipment according to claim 1, further comprising:

a heat medium heater configured to heat the heat medium supplied to said condensed water heater and said supplementary air preheater.

4. The heat recovery equipment according to claim 1, further comprising:

a heater configured to heat a bottom plate of said heat extractor unit.

5. The heat recovery equipment according to claim 1, further comprising:

a desulfurization unit that is provided in a rear side of said dry electrostatic precipitator, and that is configured to desulfurizes the flue gas.

6. The heat recovery equipment according to claim 1, further comprising:

a soot blower configured to blow off soot adhering to a heat exchange tube of said heat extractor unit; and a drain remover configured to remove steam drain of said soot blower.

7. The heat recovery equipment according to claim 6, wherein the soot blower includes a first cylinder configured to introduce the steam from said boiler, a second cylinder capable of being freely inserted into and pulled out from said first cylinder, and a steam hole formed on a tip end of a pullout side of said second cylinder, and through which the steam is capable of being ejected from said first cylinder.

8. The heat recovery equipment according to claim 6, wherein a gas flow passed through said heat extractor unit is a horizontal gas flow.

9. The heat recovery equipment according to claim 6, wherein said heat exchange tube of said heat extractor unit is a finned tube made of carbon steel.

* * * * *